US007422507B2

(12) United States Patent
Chernick et al.

(10) Patent No.: US 7,422,507 B2
(45) Date of Patent: Sep. 9, 2008

(54) TOY FIGURE THAT COMBINES PLUSH CONSTRUCTION WITH ELASTOMERIC GEL

(76) Inventors: Mark J. Chernick, 19180 144th Ave, NE., Woodinville, WA (US) 98072; Webb T. Nelson, 19180 144th Ave, NE., Woodinville, WA (US) 98072

( * ) Notice: Subject to any disclaimer, the term of this patent is extended or adjusted under 35 U.S.C. 154(b) by 181 days.

(21) Appl. No.: 11/237,817

(22) Filed: Sep. 29, 2005

(65) Prior Publication Data

US 2007/0072512 A1 Mar. 29, 2007

(51) Int. Cl.
*A63H 3/02* (2006.01)

(52) U.S. Cl. ..... 446/372; 446/369; 446/385; 446/268; 446/267; 446/183

(58) Field of Classification Search ..... 446/183, 446/267, 320, 369, 370, 372, 385, 268
See application file for complete search history.

(56) References Cited

U.S. PATENT DOCUMENTS 800,333 A * 9/1905 Smith ..... 446/370
4,369,284 A 1/1983 Chen ..... 524/476
4,952,191 A * 8/1990 Martinez ..... 446/324
5,215,493 A * 6/1993 Zgrodek et al. ..... 446/372
6,050,875 A * 4/2000 Lee ..... 446/391
6,406,499 B1 6/2002 Kania ..... 623/36
2004/0048018 A1* 3/2004 Pearce ..... 428/35.7

* cited by examiner

*Primary Examiner*—Gene Kim
*Assistant Examiner*—Urszula M Cegielnik
(74) *Attorney, Agent, or Firm*—LaMorte & Associates

(57) ABSTRACT

A toy figure assembly and its method of manufacture. The toy figure has a body structure with an exposed exterior. The exposed exterior of the figure includes at least one first section of fabric material and at least one second section of elastomeric gel material that are joined together along at least one common seam. The common seam can be closed using adhesive, heat bonding or sewing. The sections of the toy figure defined by fabric material are filled with dry fill. The sections of the toy figure defined by elastomeric gel material can be filled with either dry fill or a fluid fill. By forming a toy figure from both fabric material and elastomeric gel, a toy figure is obtained that has external areas having contrasting tactile characteristics, thereby increasing the play value of the toy figure.

13 Claims, 4 Drawing Sheets

TOY FIGURE THAT COMBINES PLUSH CONSTRUCTION WITH ELASTOMERIC GEL

BACKGROUND OF THE INVENTION

1. Field of the Invention

In general, the present invention relates to manufacturing techniques used in the fabrication of toy figures. More particularly, the present invention relates to techniques used to combine fabric construction materials with synthetic elastomeric construction materials to produce figures that embody different tactile characteristics.

2. Prior Art Description

In the toy industry, "plush toys" is the name used to describe toys with a fabric-based construction. Such toys include stuffed animals, dolls and the like. Traditionally plush toys are made by sewing together a fabric shell from some type of material, such as cotton or synthetic fur. The fabric shell defines the external shape of the toy. The fabric shell is then stuffed with polyester fibers of some similar type of stuffing material. Hard objects, such as button eyes, can then be either sewn or glued to the exterior of the fabric shell.

Throughout the long history of plush toys, there have many occasions where toy manufacturers have attempted to make toy figures that have both soft plush features and hard non-plush features. For instance, there are many dolls that have hard porcelain heads and hands, but the remainder of the doll is made with traditional plush fabric material. In order to join hard components, such as a doll head to a plush fabric body, the hard component is typically made with a grooved base. The fabric material of the plush section is passed around the grooved base and tightened with thread. The fabric material tightens within the groove, therein creating a mechanical interconnection between the plush section of the toy and the non-plush sections.

As the materials of toys evolved, many toys began to be manufactured from different types of plastic, rather than fabric. For instance, many dolls have bodies made from hard plastic. The heads of the dolls, however, are often molded from a softer more pliable plastic. Although plastic is used, the type of connections between the two different types of plastic parts remains traditional. Typically, the toy part made from the harder plastic is molded with a grooved base. The toy part made from the softer plastic is made with an opening that can be stretched around the grooved base. When the opening of softer plastic contracts into the groove of the harder plastic, a mechanical interconnection is created that joins the plastic sections.

In the toy industry, elastomeric gels are becoming increasingly popular. Elastomeric gels are triblock copolymer plastics that have been mixed with a plasticizing oil to form an elastic gel. Elastomeric gels embody a high degree of elasticity and a high resistance to tearing that make such gels useful in toy manufacturing. There are currently several elastomeric gels that are commercially available. One of the earliest elastomeric gels is exemplified by U.S. Pat. No. 4,369,284 to Chen, entitled Thermoplastic Elastomer Gelatinous Compositions.

Elastomeric gels are typically molded into toys such as balls and flying discs using traditional injection molding techniques. The use of injection molding techniques prohibits elastomeric gels from being molded directly onto a non-plastic plush form. In industry, elastomeric gels have been applied to fabric objects, such as socks, in order to provide cushioning. Consider U.S. Pat. No. 6,406,499 to Kania, entitled Gel And Cushioning Devices. However, in such applications the fabric body is dipped into a vat of molten elastomeric gel material. The elastomeric gel material is then given time to cure upon the fabric body.

A problem occurs when a toy manufacturer desires to create a figure that is part plush and part elastomeric gel. Traditional mechanical attachment techniques do not work. Since the elastomeric gel is so elastic, it easily pulls away from any sort of grooved connection base it may be stretched across. Furthermore, elastomeric gels cannot be molded onto plush toys, nor can elements of a plush toy figure be created by molten dipping. The only solution to date has been to glue elastomeric gel material to fabric using traditional acrylic based glues. However, since the traditional acrylic glues used harden when they cure, the glues quickly peel away from the elastomeric gel as the elastomeric gel stretches and deforms under the hardened glue. The component of the toy made from the elastomeric gel, therefore, quickly peels away from the remainder of the toy, where it can become a choking hazard.

A need therefore exists for an improved technique for joining elastomeric gels to the fabric shell of an otherwise plush toy. This need is met by the present invention as is described and claimed below.

SUMMARY OF THE INVENTION

The present invention is a toy figure assembly and its method of manufacture. The toy figure has a body structure with an exposed exterior. The exposed exterior of the figure includes at least one first section of fabric material and at least one second section of elastomeric gel material that are joined together along at least one common seam. The common seam can be closed using adhesive, heat bonding or sewing. The sections of the toy figure defined by fabric material are filled with dry fill. The sections of the toy figure defined by elastomeric gel material can be filled with either dry fill or a fluid fill, such as liquid or air.

By forming a toy figure from both fabric material and elastomeric gel, a toy figure is obtained that has external areas having contrasting tactile characteristics, thereby increasing the play value of the toy figure.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

There are countless varieties of plush toys. The present invention is described using one exemplary configuration of a plush toy. This configuration is intended to be merely exemplary of any plush toy configuration and should not be considered to limit the application of the present invention to other plush toy configurations.

Figure 1:
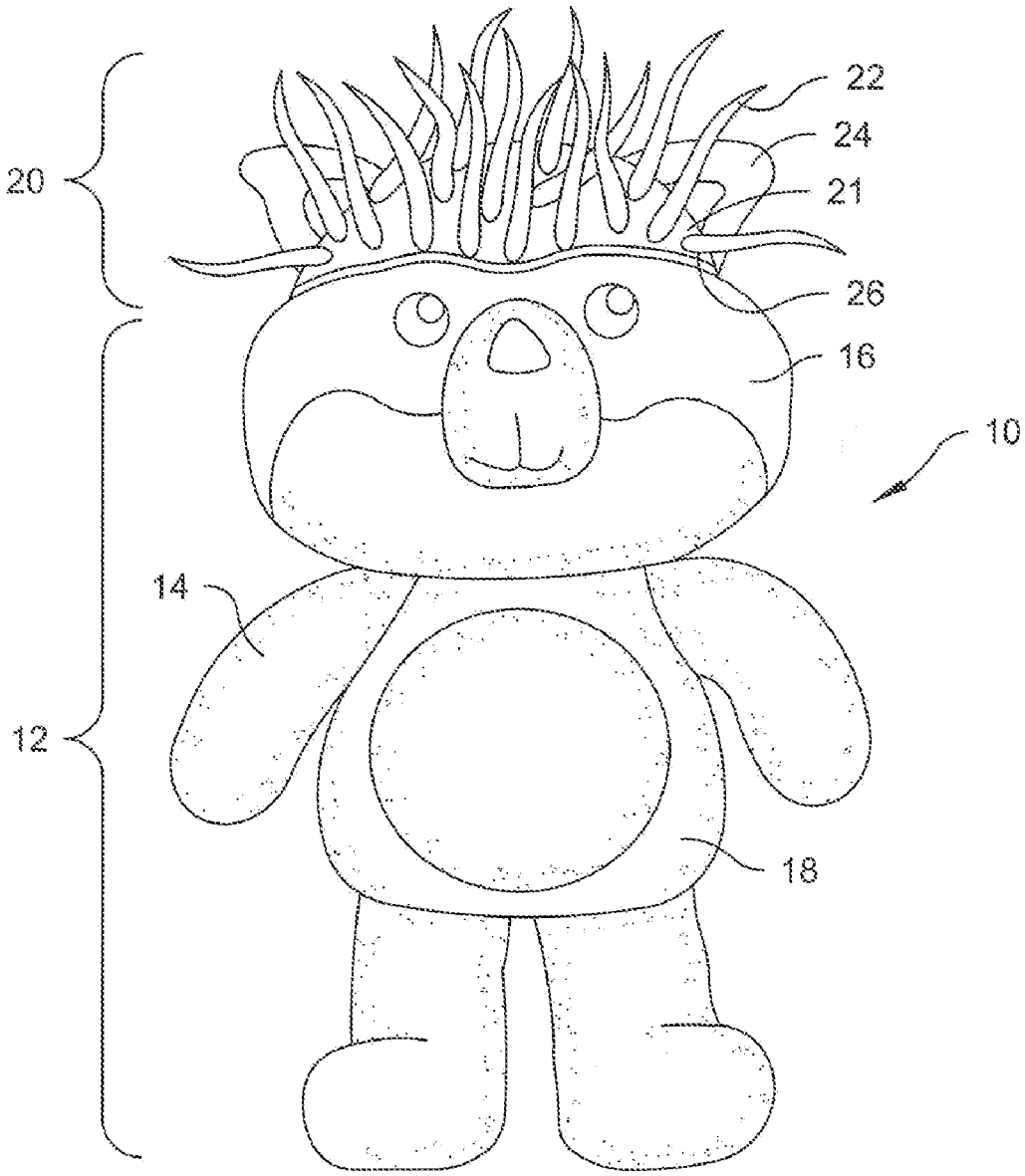
FIG. 1 is a front view of an exemplary toy figure.

Referring to FIG. 1, there is shown a toy figure. 10. The toy figure 10 has a plush section 12 made in the traditional manner. The plush section 12 is made from a sewn fabric shell 14 that is stuffed with dry fill material, such as polyester fibers. In the shown embodiment, the toy figure 10 is a doll. The plush section 12 of the doll is the body 16 and face 18 of the doll.

The toy figure 10 also has at least one stretchable section 20 that is made from an elastomeric gel. In the shown embodiment, the stretchable section 20 is the scalp 21, hair 22 and ears 24 of the toy figure 10. The stretchable section 20 is a molded segment of elastomeric gel that is prefabricated prior to the assembly of the toy figure 10. Since the stretchable section 20 of the toy figure 10 is made from elastomeric gel, it is highly elastic. It will therefore be understood that the hair 22, scalp 21 and ears 24 of the toy figure 10 can be elastically stretched by a person pulling on these elements.

The stretchable section 20 of the toy figure 10 joins to the plush section 12 of the toy figure 10 along at least one common seam 26. The physical interconnection between the stretchable section 20 and the plush section 12 can be accomplished in a few ways.

Figure 2:
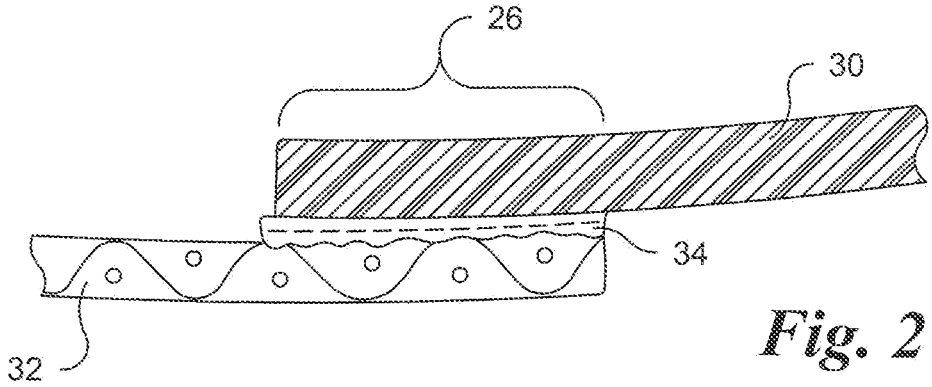
FIG. 2 is a cross sectional view of a first embodiment of a seam.

Referring to FIG. 2 a segment of the common seam 26 is shown. In the segment of the common seam 26, it can be seen that a thin layer of the elastomeric gel material 30 overlaps a segment of the fabric material 32. A thermoset glue 34 is used to bond the elastomeric gel material 30 to the fabric material 32. The thermoset glue 34 is comprised of a triblock copolymer that is mixed with a resin and optionally with a small amount of plasticizing oil. Such glues are commercially available and are exemplified by U.S. Pat. No. 6,391,960, to Sambasivam, entitled Multipurpose Hot Melt Adhesive. The thermoset glue 34 is applied to the common seam 26 in a heated molten form. The thermoset glue 34 therefore flows into the weave of the fabric material 32. Once the thermoset glue 34 cools and cures, the bond between the fabric material 32 and the thermoset glue 34 is exceptionally strong due to the seepage of the glue into the weave of the fabric material 32.

The thermoset glue 34 is made of a triblock copolymer. The elastomeric gel material 30 is made from the same family of materials. Accordingly, the elastomeric material 30 readily bonds with the thermoset glue 34. Furthermore, since the thermoset glue 34 is applied in a heated molten form, the thermoset glue 34 momentarily melts the elastomeric gel material 30 it contacts, thereby creating a direct heat bond between the elastomeric gel material 30 and the thermoset glue 34.

The thermoset glue 34 is made primarily from triblock copolymers mixed with resin and a plasticizer. The thermoset glue 34 therefore is highly flexible and exhibits a resistance to tearing comparable to that of the elastomeric gel material 30. The result is that the common seam 26 is strongly bonded to both the elastomeric gel material 30 and the fabric material 32. The thermoset glue 34 will also bend and twist as the elastomeric gel material 30 is stretched, without pulling away from either the elastomeric gel material 30 or the fabric material 32.

Figure 3:
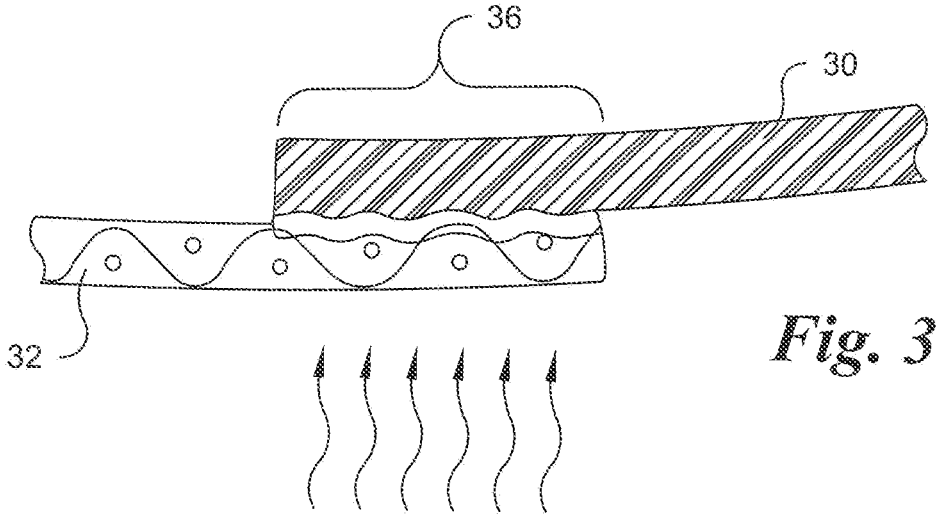
FIG. 3 is a cross sectional view of a second embodiment of a seam.

Referring to FIG. 3 an alternate embodiment of a segment of common seam 36 is shown. In this segment of a common seam 36, a layer of the elastomeric gel material 30 again overlaps a layer of fabric material 32. No secondary adhesive is used between the elastomeric gel material 30 and the fabric material 32. Rather, the elastomeric gel material 30 is brought into contact with the fabric material 32. Energy is then applied to the common seam 36 in the form of heat energy, ultrasound energy or microwave energy. The energy is used to momentarily melt the elastomeric gel material 30 in contact with the fabric material 32. As the melting energy is present, the fabric material 32 is biased against the elastomeric gel material 30. The result is that the elastomeric gel material 30 melts into the fibers of the fabric material 32. Once the melting energy is removed, the elastomeric gel material 30 cures and becomes interlocked within the weave of the fabric material 32. The result is a bond along the common seam 36 that will not separate as the elastomeric gel material 30 is stretched.

Figure 4:
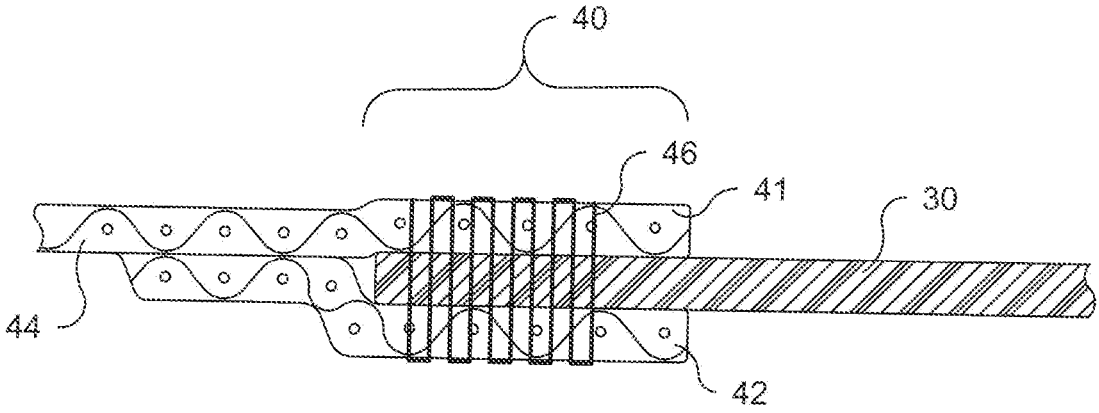
FIG. 4 is a cross sectional view of a third embodiment of a seam.

Referring to FIG. 4 another alternate embodiment of a segment of a common seam 40 is shown. In this segment of a common seam 40, a layer of elastomeric gel material 30 is placed in between two flaps 41, 42 of fabric material 44. In general, when elastomeric gel material is sewn, the threads used in the sewing tend to cut through the elastomeric gel material over time. This effect is exasperated by the stretching of the elastomeric gel material along the seam. By placing the elastomeric gel material 30 in between two flaps 41, 42 of fabric material 44, the common seam 40 can be effectively sewn together. Since the elastomeric gel material 30 is in between the two flaps 41, 42, the sewing thread 46 is not pulled laterally across the elastomeric gel material 30. Rather, the sewing threads 46 only travel vertically through the elastomeric gel material 30. The sewing threads 46 are moved laterally only above the upper flap 42 and below the lower flap 41. The sewing of the common seam 40 compresses the elastomeric gel material 30 in between the two flaps 41, 42 of fabric material 44. Since the elastomeric gel material 30 is recompressed by the sewing of the common seam 40, the elastomeric gel material 30 does not significantly further deform as the stretchable section of the toy figure is pulled and stretched. The result is very string mechanical connection between the elastomeric gel material 30 and the fabric material 44 that will not separate as the elastomeric gel material 30 is pulled and stretched.

In the embodiment of FIG. 1, a toy figure 10 is shown having a stretchable section 20 and a plush section 12. Although the exterior of the toy figure 10 is made from different materials, the toy figure 10 is filled with a common dry fill material.

Elastomeric gels are hydrophobic and are capable of holding liquid and semi-liquid materials. Plush materials cannot. Thus, in the embodiment of FIG. 1, the toy figure 10 must be filled with a dry fill material so that fill material does not leak out of the plush section 12 of the toy figure 10.

Figure 5:
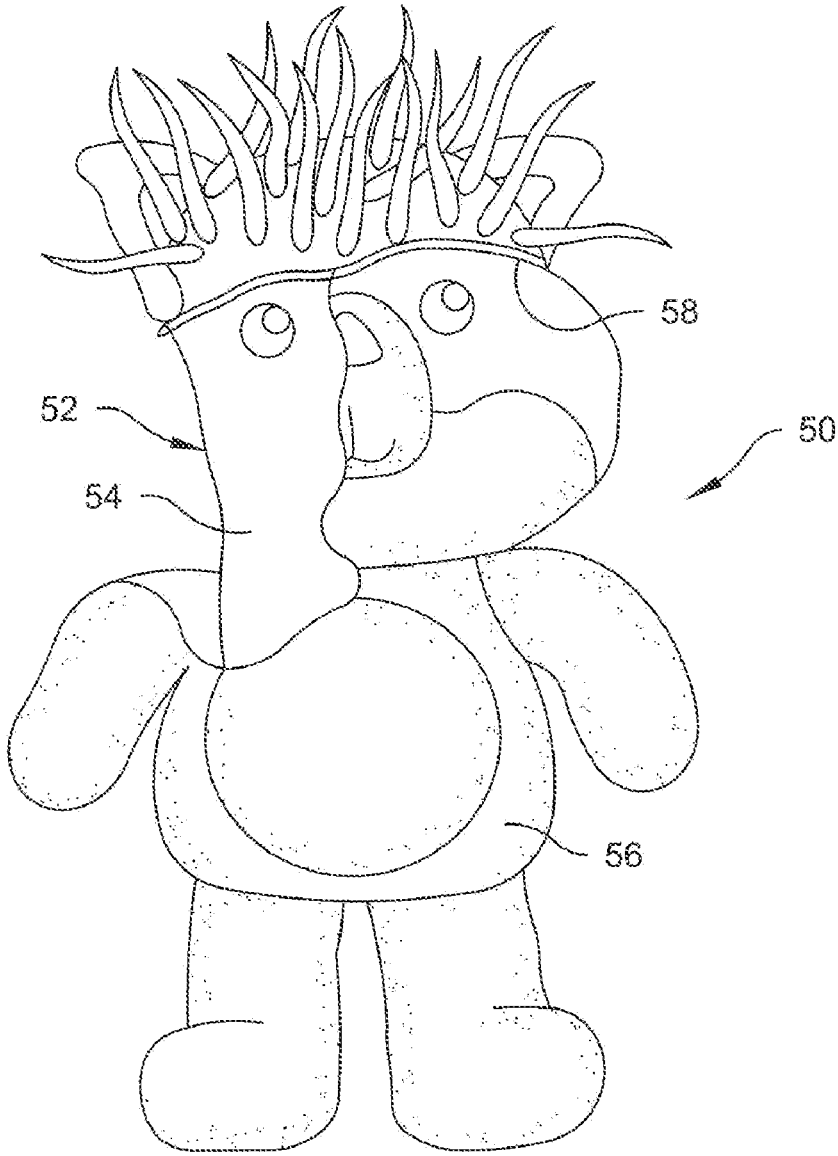
FIG. 5 is a selectively fragmented view of an alternate embodiment of a toy figure.

Referring to FIG. 5 an alternate embodiment of the present invention toy figure 50 is shown. In this embodiment, an elastomeric subassembly 52 is combined with a plush construction 56 to create the toy figure 10. The elastomeric subassembly 52 is comprised of a sealed sack 54 of elastomeric gel material that is filled with gas, liquid, gel or another such fluidic material. When the elastomeric subassembly 52 is squeezed, the elastomeric subassembly 52 will deform and bulge in areas that are not under compression.

The plush construction 56 is not completely filled with traditional fill material. Rather, the plush construction 56 is made to be at least partially hollow. In this manner, the plush construction 56 is partially hollow and a substantial portion of the sealed sack 54 of elastomeric gel can pass into the plush construction 56. The plush construction 56 has an edge that contacts the elastomeric subassembly 52 along one or more seam lines 58. On each of the seam lines 58, the fabric material of the plush construction 56 is attached to the elastomeric material of the sealed sack 54 using one of the interconnection techniques previously described.

Figure 6:
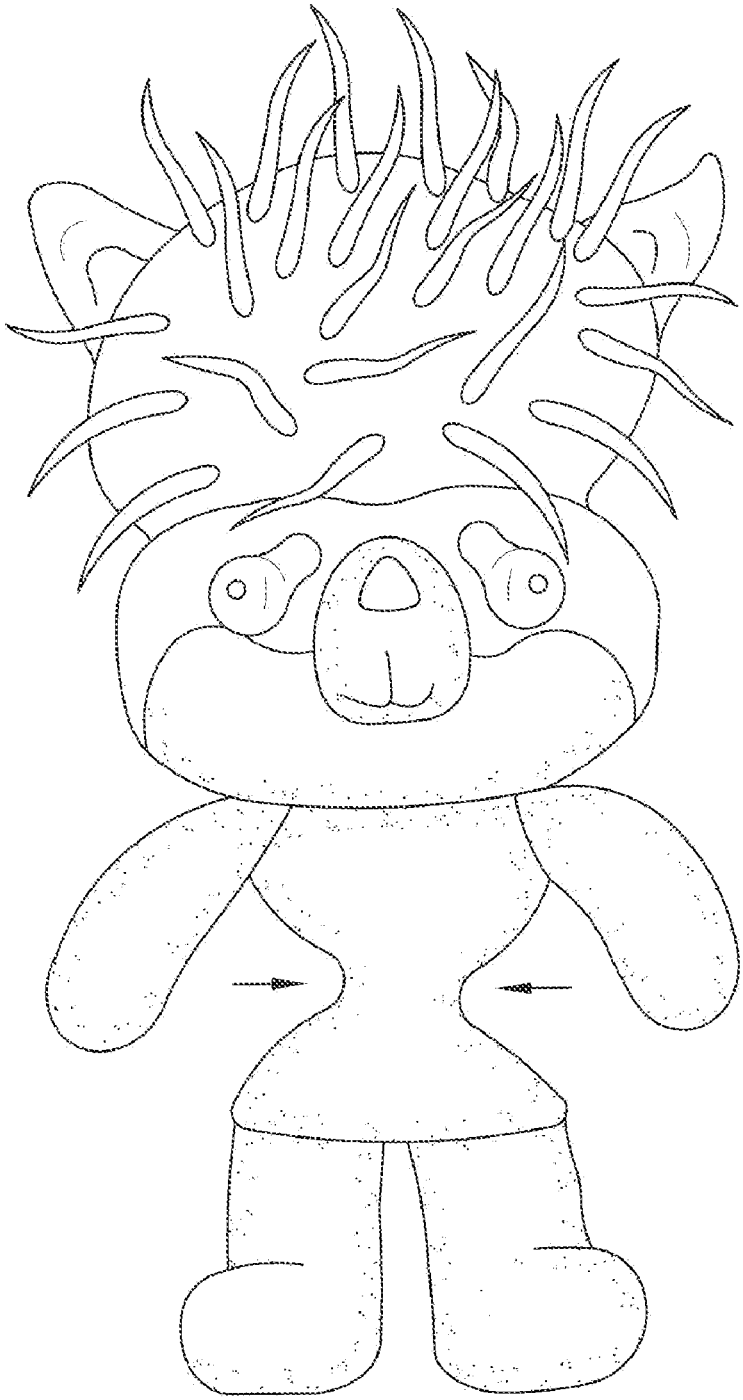
FIG. 6 is a front view of the toy figure of FIG. 5 being squeezed.

Referring to FIG. 6 it can be seen that since a portion of the elastomeric subassembly 52 is located within the plush construction 56, when the plush construction 56 is squeezed, the exposed portions of the elastomeric subassembly 52 bulge.

The plush construction 56 can be made with complex openings that expose different sections of the elastomeric subassembly 52. Consequently, when the plush construction 56 is squeezed, the openings in the plush construction 56 can control where the elastomeric subassembly 52 deforms. For example, in the shown embodiment, the toy figure 50 is a stuffed animal made in the form of a raccoon. The toy figure 50 has a head 61 and body 62. The body 62 is made of traditional plush construction. The head 61 is partially made of plush construction. The remainder of the head 61 is made from the exposed sections of an elastomeric subassembly 52 that is partially enveloped by the plush construction 56. When the toy figure 50 is squeezed, the exposed sections of the elastomeric subassembly 52 bulge. The elastomeric subassembly 52 bulges in areas unrestricted by the plush construction 56. In the shown embodiment, those unrestricted areas comprise the ears and eyes of the toy figure. Thus, when the body 62 of the toy figure 50 is squeezed, its ears and eyes bulge.

The embodiments of the present invention illustrate a new toy figure construction. The toy figure has external portions that are made of traditional plush construction and other portions that are made from elastomeric gel. The fill material under the elastomeric gel can also be different from the fill under the plush construction. The toy figure therefore will have external portions that vary greatly in tactile characteristics.

It will be understood that the embodiments illustrated are merely exemplary and that a person skilled in the art can make alternate embodiments without departing from the principals of the invention. The toy figure can take any shape. It can be a person, an animal or an inanimate object. The shape of the toy figure is a matter of design choice. What is important is that elastomeric material and fabric material are both used to create the toy figure. The elastomeric material is not separate from the plush construction, but rather the elastomeric material and the fabric material are joined together along common seams and integrate to form a toy figure with unique tactile features. Consequently, variations, modifications and alternate embodiments of the illustrated embodiments are intended to be covered by the scope of the claims as defined below.

What is claimed is:

1. A toy figure assembly, comprising:

a body structure having an exposed exterior comprised of at least one first section of fabric material, and at least one second section of elastomeric gel material, wherein said at least one first section and said at least one second are joined along at least one common seam;

a sealed sack of elastomeric gel material disposed within said body structure, wherein said sealed sack surrounds a volume of a fluidic fill, and wherein said second section of elastomeric gel material is part of said sealed sack; and dry plush fill material stuffing at least part of said body structure not occupied by said sealed sack.

2. The assembly according to claim 1, wherein said body structure includes a plush section defined by said at least one first section of fabric material.

3. The assembly according to claim 2, wherein said sealed sack of elastomeric gel material is at least partially surrounded by said plush section and joined to said plush section along said at least one common seam.

4. The assembly according to claim 3, wherein said sealed sack of elastomeric gel material bulges when compressed.

5. The assembly according to claim 4, wherein said plush section restricts said sealed sack of elastomeric gel material to only bulge in said at least one second section when said toy figure is squeezed.

6. A toy figure assembly, comprising:

a body structure having an exposed exterior comprised of at least one first section of fabric material, and at least one second section of elastomeric gel material, wherein said elastomeric gel contains a triblock copolymer, and wherein said at least one first section and said at least one second section are joined along at least one common seam;

a thermoset adhesive applied along said at least one common seam, wherein said thermoset adhesive contains a triblock copolymer and adhesively bonds said fabric material to said elastomeric gel; and dry plush fill material stuffing at least part of said body structure.

7. The assembly according to claim 1, wherein said fabric material and said elastomeric gel material are sewn together along said at least one common seam.

8. A toy figure comprising:

a head section;

a body section;

wherein said body section has an exterior comprised primarily of fabric; and wherein said head section has an exterior at least partially comprised of an elastomeric gel and at least partially comprised of fabric, wherein said elastomeric gel and said fabric are joined together along at least one common seam within said head section.

9. The toy figure according to claim 8, wherein said head section includes hair and facial features.

10. The toy figure according to claim 9, wherein said hair is comprised of elongated elements of elastomeric gel.

11. The toy figure according to claim 9, wherein at least some of said facial features are comprised of elastomeric gel.

12. The toy figure according to claim 9, wherein said fabric is joined to said elastomeric gel along said at least one common seam with a thermoset adhesive.

13. The toy figure according to claim 9, wherein said fabric is joined to said elastomeric gel along said at least one common seam with heat bonding.

* * * * *